US010492611B2

(12) United States Patent
Huang et al.

(10) Patent No.: US 10,492,611 B2
(45) Date of Patent: Dec. 3, 2019

(54) DUAL-PURPOSE WORK CHAIR

(71) Applicant: HIEVER CO., LTD., Taichung (TW)

(72) Inventors: Tony Huang, Taichung (TW); Jeffery Huang, Taichung (TW)

(73) Assignee: HIEVER CO., LTD., Taichung (TW)

( * ) Notice: Subject to any disclaimer, the term of this patent is extended or adjusted under 35 U.S.C. 154(b) by 0 days.

(21) Appl. No.: 16/237,996

(22) Filed: Jan. 2, 2019

(65) Prior Publication Data

US 2019/0200766 A1 Jul. 4, 2019

(30) Foreign Application Priority Data

Jan. 3, 2018 (TW) ..... 107200089 U

(51) Int. Cl.

| | |
|---|---|
| ***B62H 5/00*** | (2006.01) |
| ***A47C 3/36*** | (2006.01) |
| ***A47C 9/02*** | (2006.01) |
| ***A47C 7/00*** | (2006.01) |

(52) U.S. Cl.

CPC ..... *A47C 3/36* (2013.01); *A47C 7/006* (2013.01); *A47C 9/027* (2013.01)

(58) Field of Classification Search

CPC ..... A47C 3/36; A47C 7/006; A47C 9/027; A47C 13/00; B25H 5/00

USPC ..... 280/30, 32.6, 642

See application file for complete search history.

(56) References Cited

U.S. PATENT DOCUMENTS

| | | | | |
|---|---|---|---|---|
| 5,451,068 | A * | 9/1995 | Shockley | B25H 5/00 280/32.6 |
| 5,790,997 | A * | 8/1998 | Ruehl | A47C 17/162 297/316 |
| 6,095,532 | A * | 8/2000 | Martin | B25H 5/00 280/30 |
| 6,199,877 | B1 * | 3/2001 | Shockley | B25H 5/00 280/32.6 |
| 6,425,590 | B1 * | 7/2002 | Whiteside | B25H 5/00 280/32.5 |
| 6,578,857 | B1 * | 6/2003 | Whiteside | B25H 5/00 280/32.5 |
| 6,834,868 | B1 * | 12/2004 | Blackburn | B25H 5/00 280/32.6 |
| 6,871,861 | B2 * | 3/2005 | Hernandez, Jr. | B25H 5/00 248/129 |
| 6,969,077 | B2 * | 11/2005 | Liu | B25H 5/00 280/30 |
| 7,481,438 | B2 * | 1/2009 | Hernandez | B25H 5/00 280/32.5 |
| 8,596,651 | B2 | 12/2013 | Canova | |

(Continued)

*Primary Examiner* — Paul N Dickson
*Assistant Examiner* — Hilary L Johns
(74) *Attorney, Agent, or Firm* — Muncy, Geissler, Olds & Lowe, P.C.

(57) ABSTRACT

A dual-purpose work chair includes a base frame including a transverse portion, a longitudinal portion vertically located on the transverse portion and a plurality of rollers provided at the bottom side thereof, a first pivoting frame pivotally connected to the transverse portion and protruding beyond the base frame and biasable between a horizontal position and a vertical position, a lower seat cushion located on the first pivoting frame, a second pivoting frame pivotally connected to the longitudinal portion and biasable from a vertical position to a horizontal position across the first pivoting frame, and an upper seat cushion located on the second pivoting frame.

10 Claims, 9 Drawing Sheets

(56) References Cited

U.S. PATENT DOCUMENTS

| | | | | |
|---|---|---|---|---|
| 9,610,682 | B2 * | 4/2017 | Shaner | B25H 5/00 |
| 10,232,504 | B1 * | 3/2019 | Whiteside | B25H 5/00 |
| 2008/0157492 | A1 * | 7/2008 | Chaykin | A47C 13/00<br>280/32.6 |
| 2012/0038122 | A1 * | 2/2012 | Canova | A47C 3/36<br>280/32.6 |
| 2014/0339783 | A1 * | 11/2014 | Dall'Armi | B25H 5/00<br>280/32.6 |
| 2018/0235369 | A1 * | 8/2018 | Rivera, Jr. | A47C 4/04 |

* cited by examiner

DUAL-PURPOSE WORK CHAIR

BACKGROUND OF THE INVENTION

1. Field of the Invention

The present invention relates to work chairs for use in maintenance works and more particularly, to a dual-purpose work chair that can be adjusted to change the height of the seat.

2. Description of the Related Art

Generally, when performing a maintenance work, such as automobile repair, it takes a long time to squat down or to sit on the floor. In order to make the maintenance personnel have a more comfortable posture, the maintenance personnel usually will use a work chair. For example, U.S. Pat. No. 8,596,651 disclosed a work seat that is provided with rollers at the bottom side thereof facilitating movement by the maintenance personnel and can be adjusted to change the height according to different application needs.

SUMMARY OF THE INVENTION

The present invention has been accomplished under the circumstances in view. It is the main object of the present invention to provide a dual-purpose work chair that can change the height of the seat after simple folding conversion.

To achieve this and other objects of the present invention, a dual-purpose work chair comprises a base frame comprising a transverse portion, a longitudinal portion vertically located on the transverse portion and a plurality of rollers provided at a bottom side thereof, a first pivoting frame pivotally connected to the transverse portion and protruding beyond the base frame and biasable relative to the base frame between a horizontal position and a vertical position, a lower seat cushion located on the first pivoting frame, a second pivoting frame pivotally connected to the longitudinal portion and biasable relative to the base frame between a vertical position and a horizontal position, and an upper sear cushion located on the second pivoting frame. The second pivoting frame can be biased relative to the base frame from the original vertical position to the horizontal position to be placed across the first pivoting frame to change the height of the work chair.

Other advantages and features of the present invention will be fully understood by reference to the following specification in conjunction with the accompanying drawings, in which like reference signs denote like elements, components, objects, structures, systems, architectures, devices, processes, methods, or steps.

DETAILED DESCRIPTION OF THE INVENTION

Figure 1:
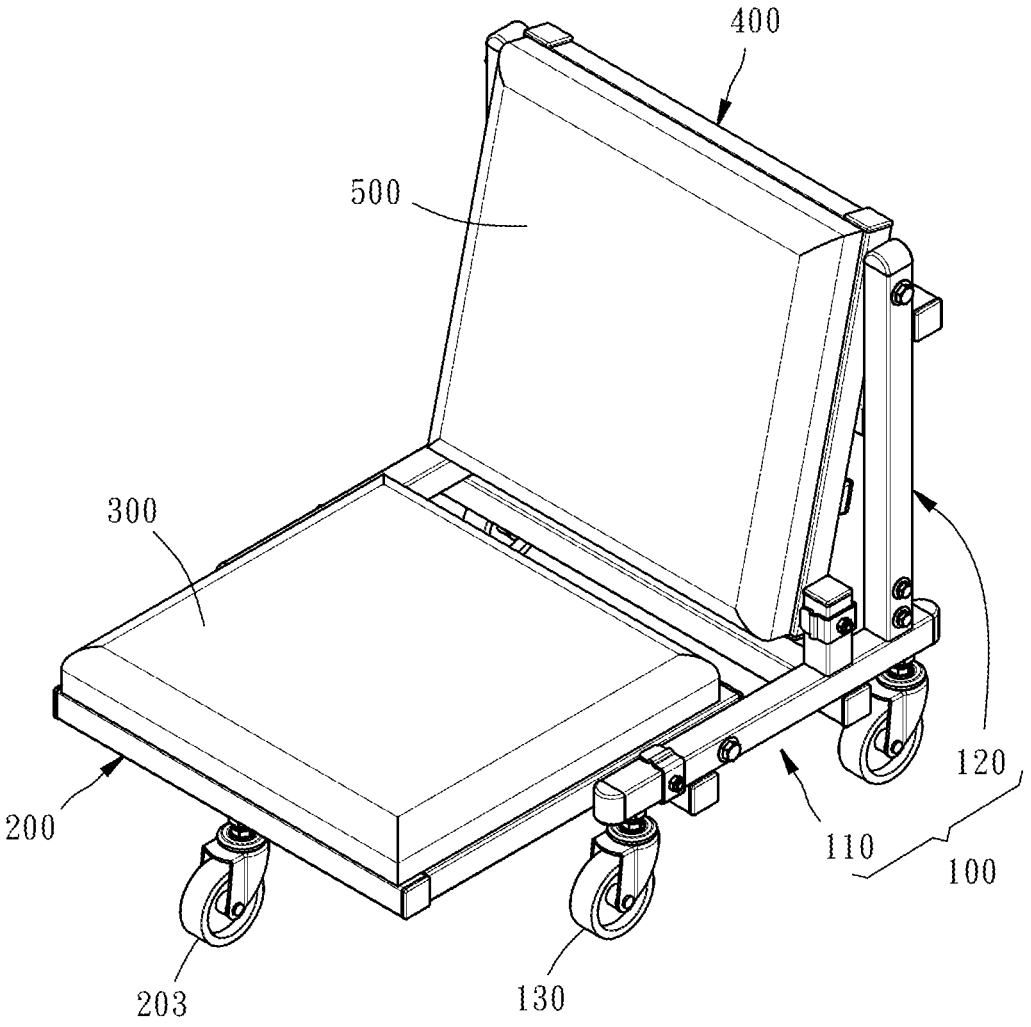
FIG. 1 is an oblique top elevational view of a dual-purpose work chair in accordance with the present invention.
Figure 2:
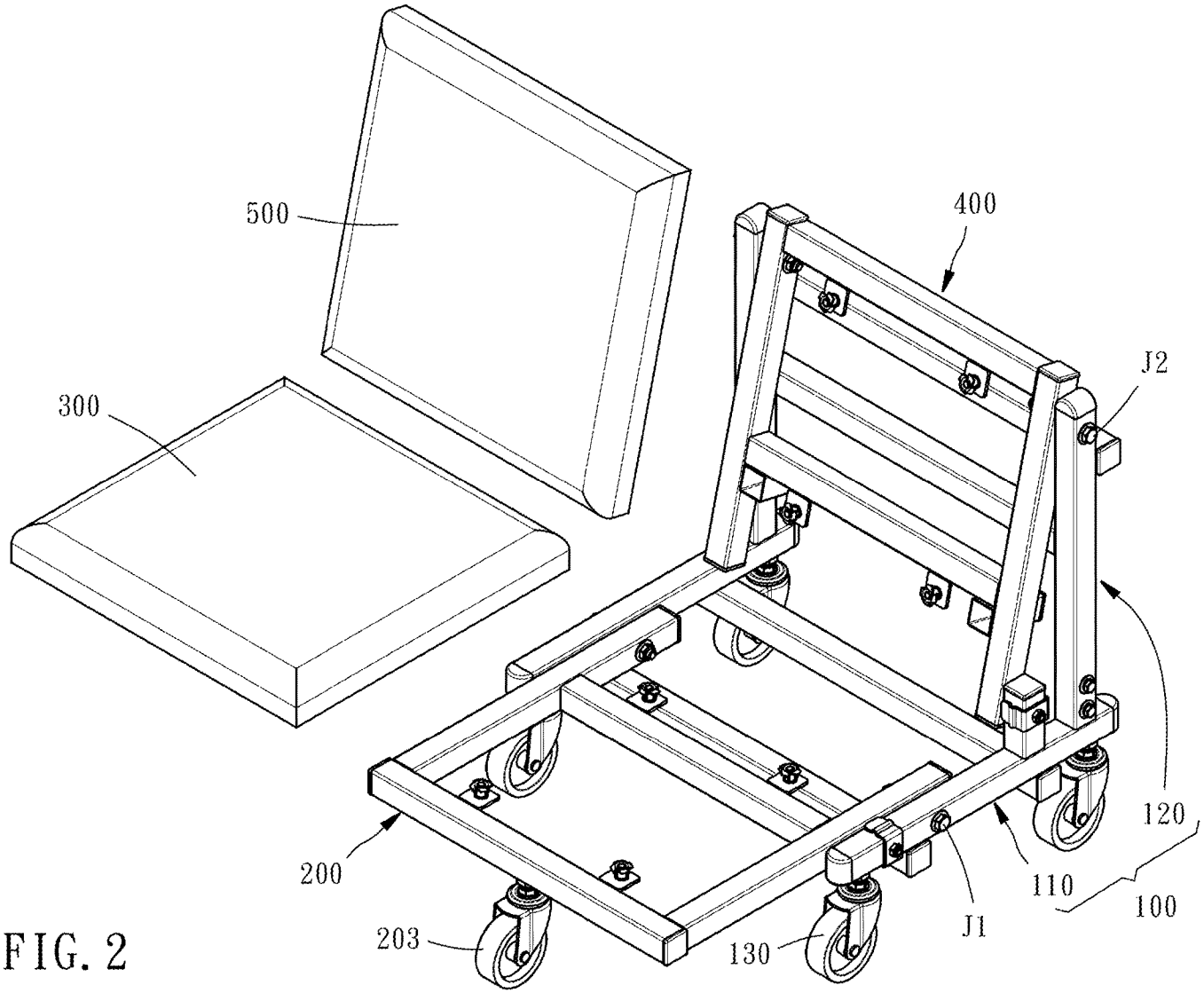
FIG. 2 is an elevational view of the present invention after detachment of the upper and lower seat cushions.

Referring to FIGS. 1-4, a dual-purpose work chair in accordance with the present invention is shown. The dual-purpose work chair comprises a base frame (100), a first pivoting frame (200), a lower seat cushion (300), a second pivoting frame (400), and an upper seat cushion (500).

The base frame (100) comprises a transverse portion (110) and a longitudinal portion (120). The transverse portion (110) includes two Y bars (111) and two X bars (112). The two X bars (112) are respectively connected to the two Y bars (111) with their two ends. The bottom surface of the transverse portion (110) of the base frame (100) is provided with a plurality of rollers (130), so that the base frame (100) can be placed on a support surface, such as a floor, and can be moved by scrolling of the rollers (130). The longitudinal portion (120) is erected on the transverse portion (110), comprising two Y bars (121) and two X bars (122). The two X bars (122) are respectively connected to the two Y bars (121) with their two ends. The two Y bars (121) of the longitudinal portion (120) have respective one ends thereof respectively affixed to the Y bars (111) of the transverse portion (110).

The first pivoting frame (200) is pivotally connected to the transverse portion (110) of the base frame (100) and protruding beyond the base frame (100). The first pivoting frame (200) comprises two Y bars (201) and two X bars (202). These two X bars (202) are respectively connected to the two Y bars (201) with their two ends. The two Y bars (201) of the first pivoting frame (200) have respective one ends thereof respectively pivotally connected to respective one ends of the two Y bars (111) of the transverse portion (110) of the base frame (100) remote from the longitudinal portion (120) of the base frame (100) so that the two Y bars (201) of the first pivoting frame (200) are disposed between the two Y bars (111) of the transverse portion (110) of the base frame (100) and the first pivoting frame (200) can be rotated with the two pivot points (J1) as a rotating shaft from an original horizontal position to an vertical position. A roller (203) is disposed under the first pivoting frame (200) to support the first pivoting frame (200), preventing the first pivoting frame (200) from tilting downward.

The lower seat cushion (300) is located on the first pivoting frame (200).

The second pivoting frame (400) is pivotally connected to the longitudinal portion (120) of the base frame (100), comprising two Y bars (401) and two X bars (402). The two X bars (402) are respectively connected to the two Y bars (401) with their two ends. The two Y bars (401) of the second pivoting frame (400) have respective one ends thereof respectively pivotally connected to respective one ends of the two Y bars (121) of the longitudinal portion (120) of the base frame (100) remote from the transverse portion (110) of the base frame (100) so that the two Y bars (401) of the second pivoting frame (400) are disposed between the two Y bars (121) of the longitudinal portion (120) of the base frame (100) and the second pivoting frame (400) can be rotated with the two pivot points (J2) as a rotating shaft from an original vertical position to a horizontal position.

The upper seat cushion (500) is located on the second pivoting frame (400).

With the above structure, the work chair can provide two different heights of use. The first height of use is as shown in FIGS. 1-4, where the first pivoting frame (200) and the second pivoting frame (400) are not rotated, so the first pivoting frame (200) is in the horizontal position, and the second pivoting frame (400) is in the vertical position, and at this time, the maintenance personnel can sit on the lower seat cushion (300) and the upper seat cushion (500) can be used as the backrest for the maintenance personnel. The overall height of the work chair in this first height of use is in a state close to the ground.

Figure 5:
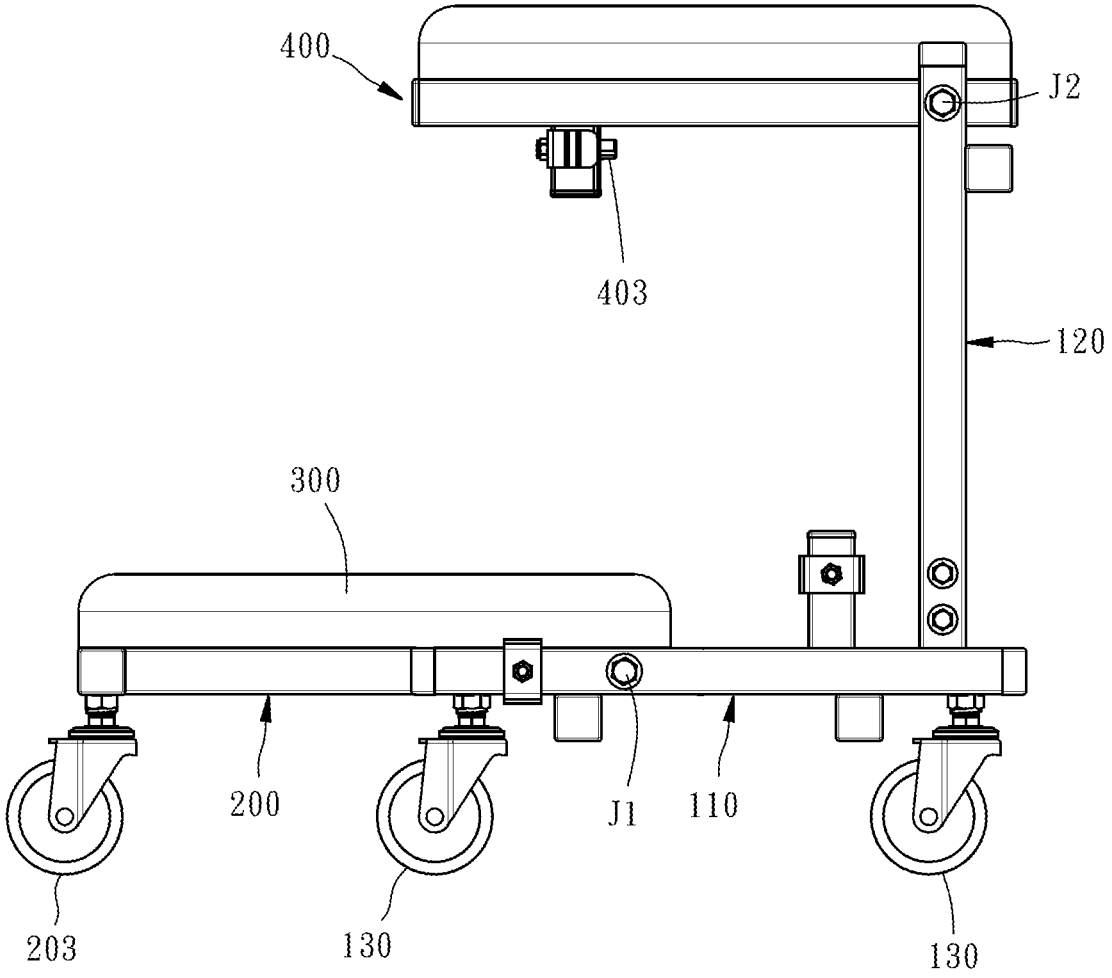
FIGS. 5 and 6 are similar to FIG. 4, showing the seat height adjustment operation.
Figure 6:
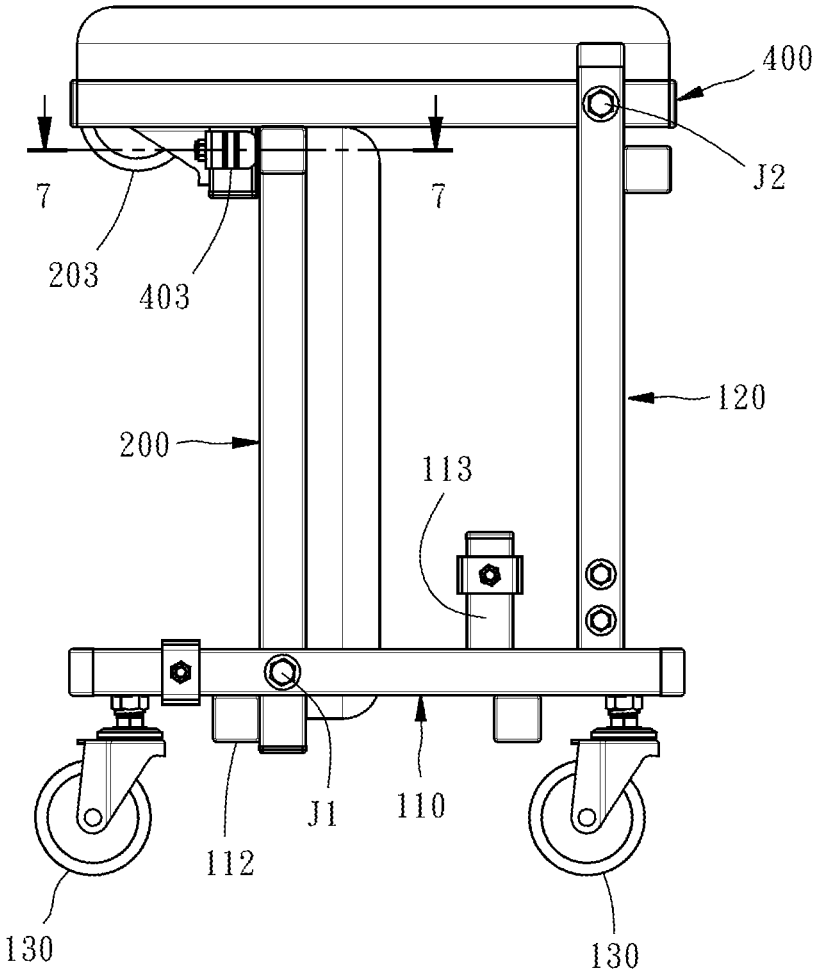

When changing the height of use, first turn the second pivoting frame (400) upwardly from the original longitudinal position to the horizontal position, as shown in FIG. 5. Then, turn the first pivoting frame (200) upwardly from the original horizontal position to the vertical position, enabling the second pivoting frame (400) to be placed across the first pivoting frame (200), as shown in FIG. 6. In this way, the upper seat cushion (500), which was originally used as the backrest, is transformed into a seat cushion for sitting by the maintenance personnel, and the seat height of the entire work chair is changed from the original low position to a high position to provide the second height of use.

In order to further improve the stability of use, when the first pivoting frame (200) is rotated from the horizontal position to the vertical position, the Y bars (201) of the first pivoting frame (200) can be pressed against one X bar (112) of the transverse portion (110) of the base frame (100) to prevent the first pivoting frame (200) from rotating at an excessive angle, as shown in FIG. 6.

Figure 7:
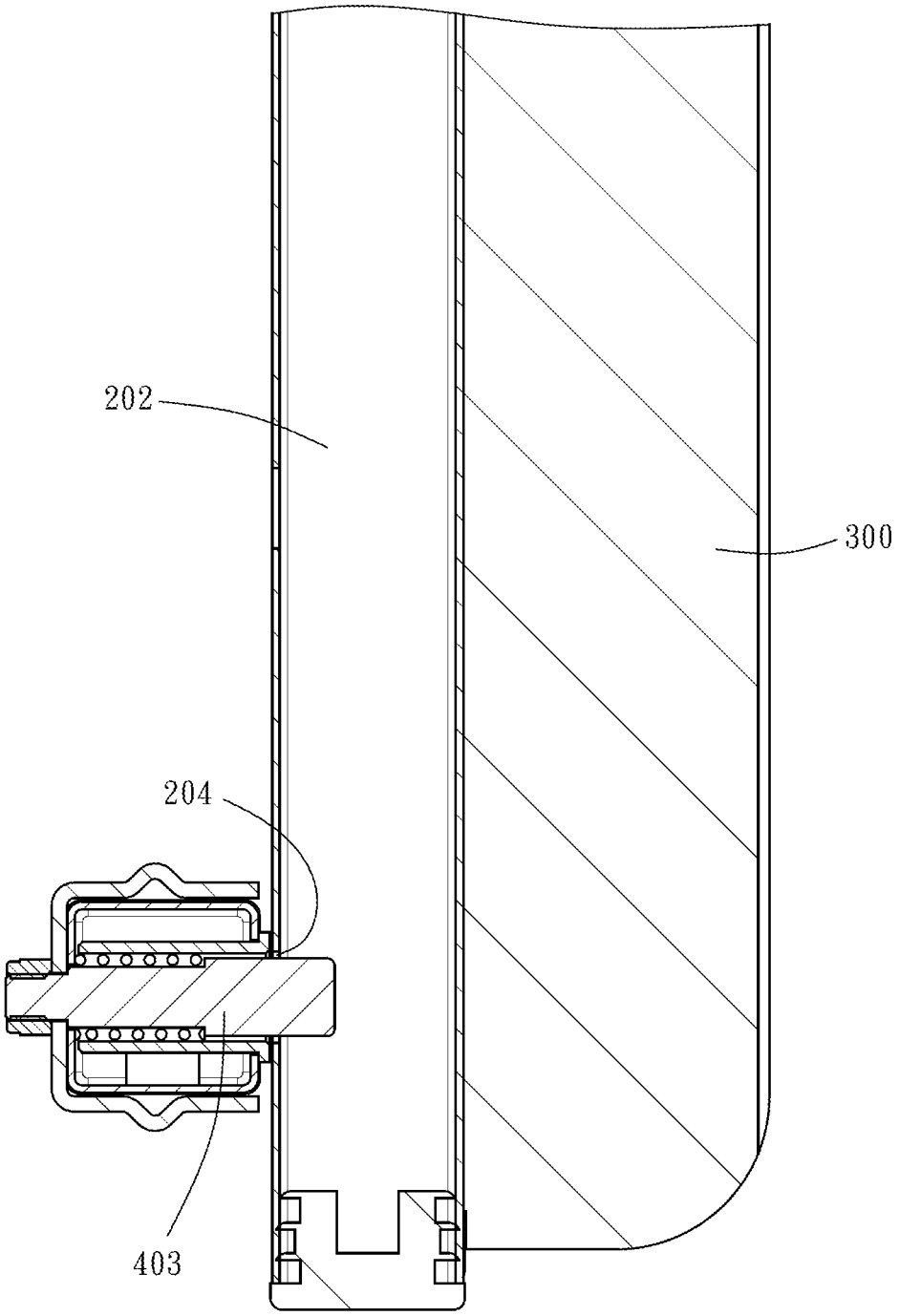
FIG. 7 is a schematic sectional view, illustrating the connection between the first locating member and the first locating portion.

The second pivoting frame (400) is provided with a first locating member (403), and the first pivoting frame (200) is provided with a first locating portion (204). Fixation between the first locating member (403) and the first locating portion (204) can make the second pivoting frame (400) more stable when it is placed on the first pivoting frame (200). In this embodiment, the first locating member (403) is a locating pin, and the first locating portion (204) is a pin hole. By means of plugging the locating pin into the pin hole, the second pivoting frame (400) is locked to the first pivoting frame (200) to enhance the positioning stability, as shown in FIG. 7. Of course, the fixing manner between the first and second pivoting frames is not limited thereto, and other fixing methods such as screw locking or clamp clamping may be used.

Further, the base frame (100) is provided with a second locating member (140) and a third locating member (150); the first pivoting frame (200) is provided with a second locating portion (205) for the fastening of the second locating member (140); the second pivoting frame (400) is provided with a third locating portion (404) for the fastening of the third locating member (150).

Figure 3:
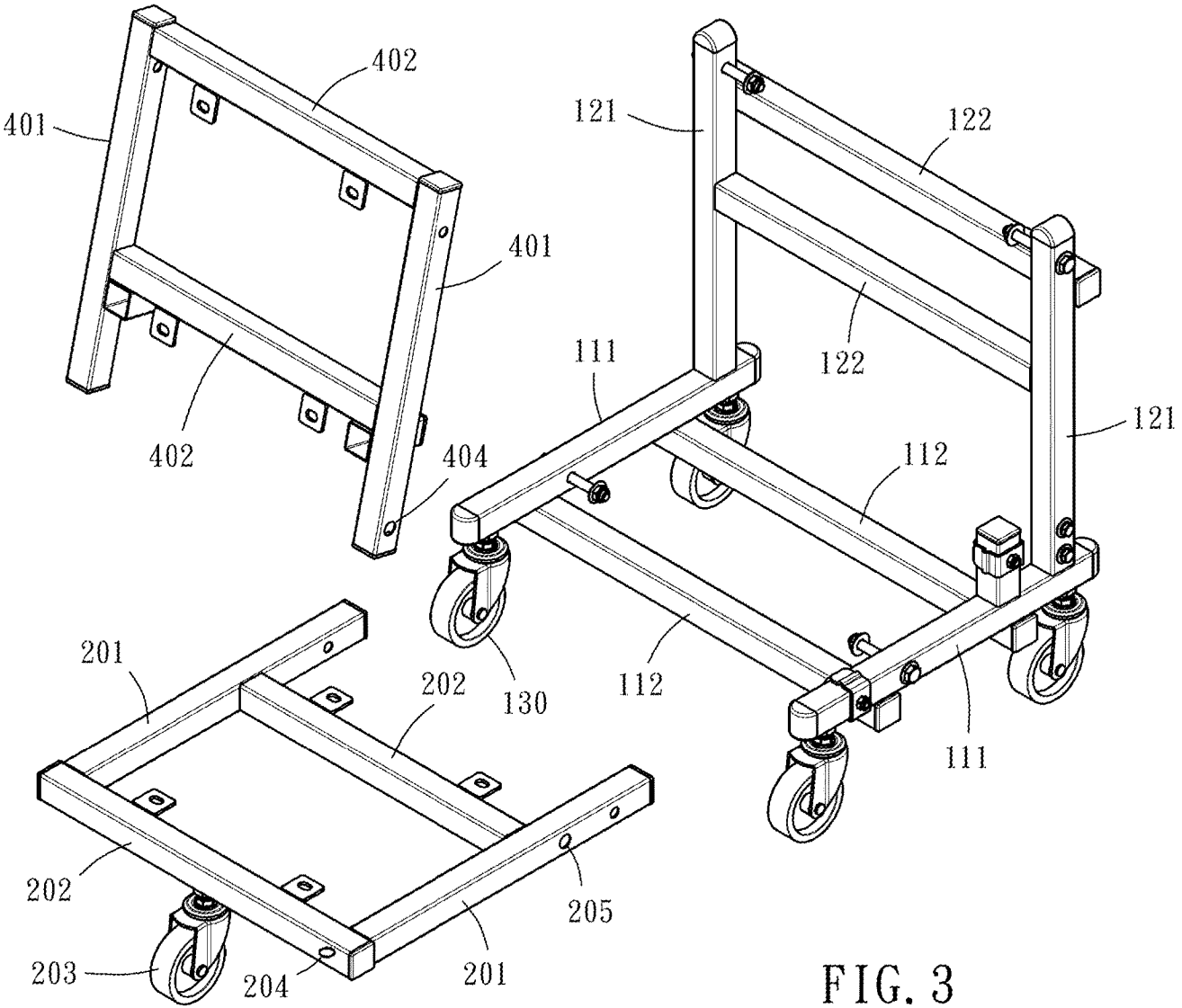
FIG. 3 is an exploded view of the dual-purpose work chair in accordance with the present invention.
Figure 4:
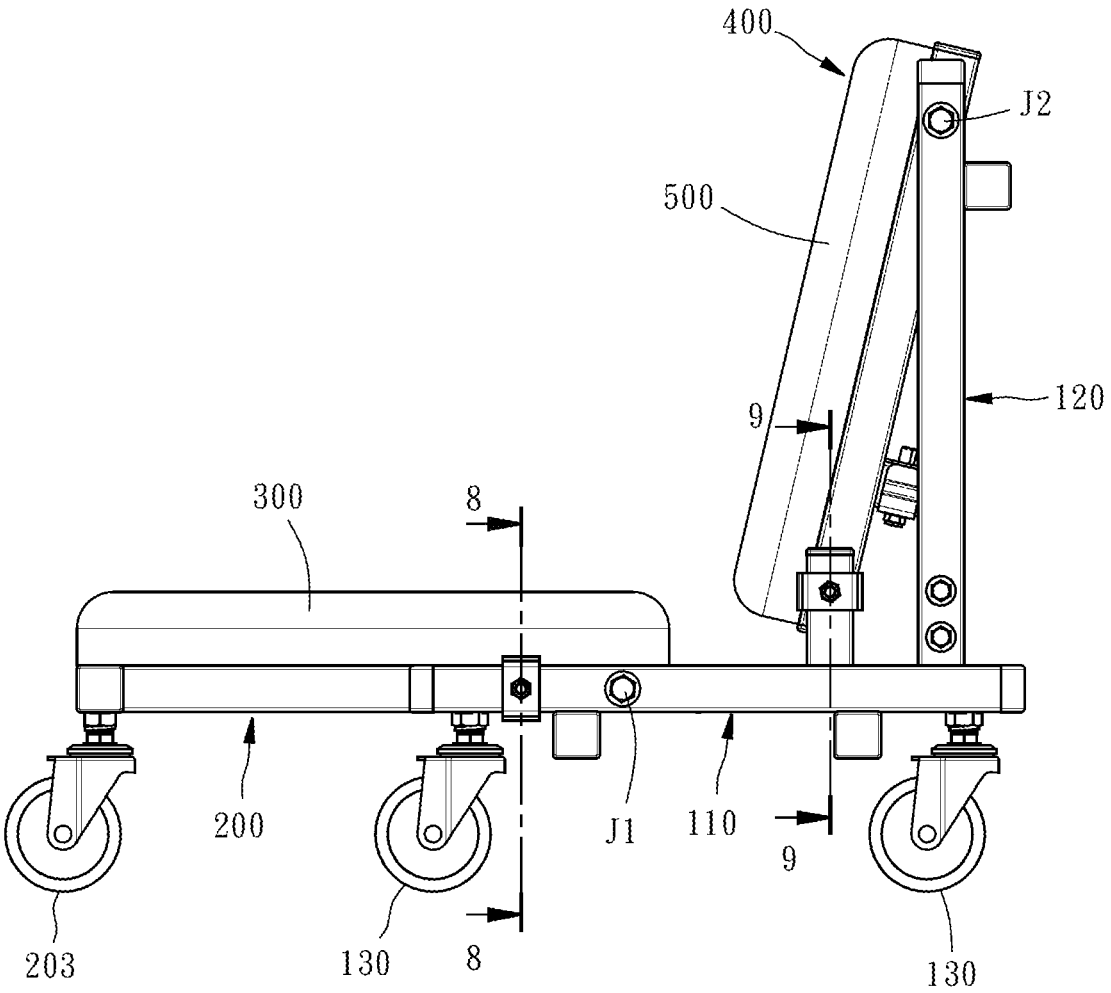
FIG. 4 is a side view of the dual-purpose work chair in accordance with the present invention.
Figure 8:
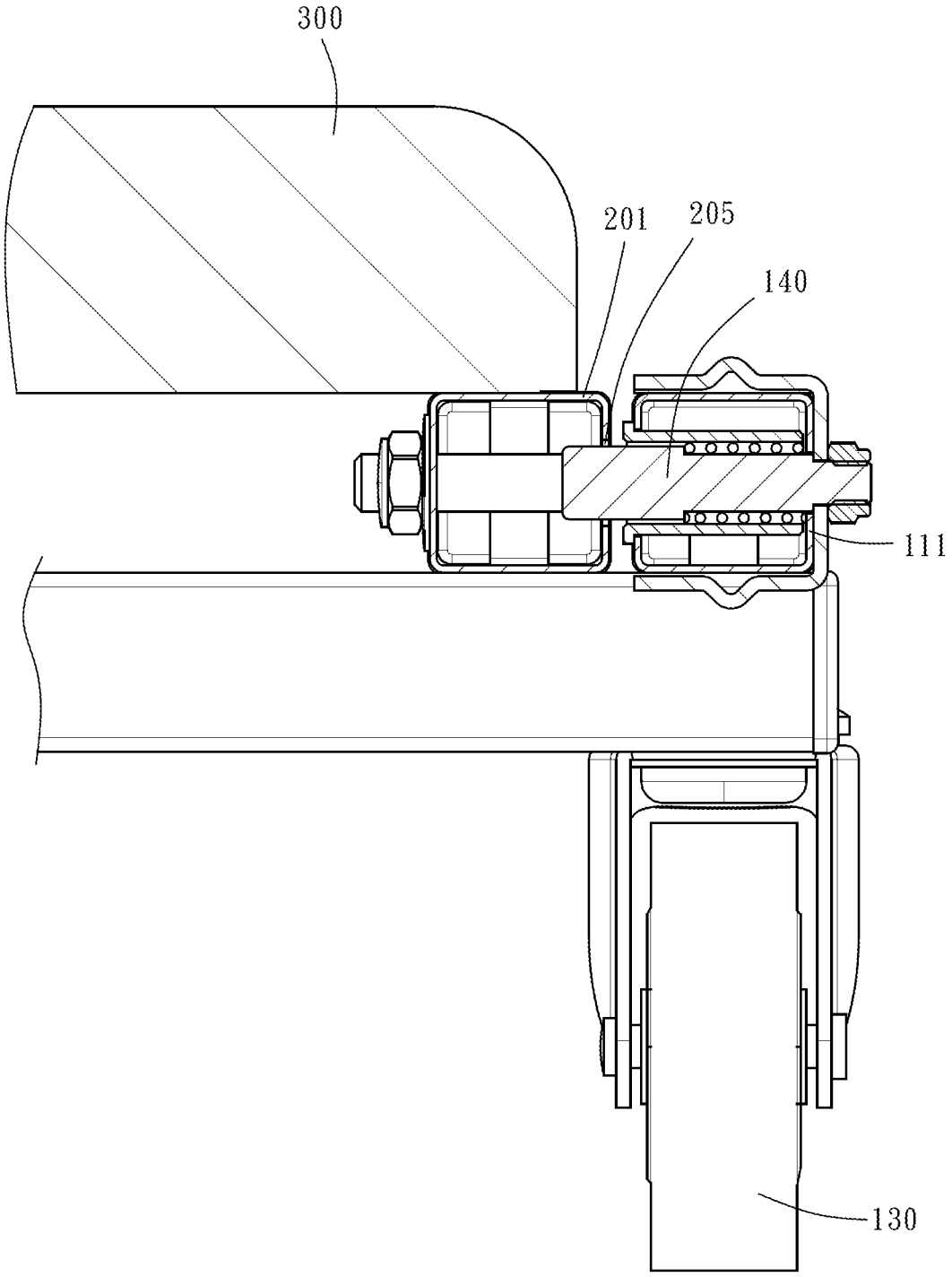
FIG. 8 is a schematic sectional view, illustrating the connection between the second locating member and the second locating portion.
Figure 9:
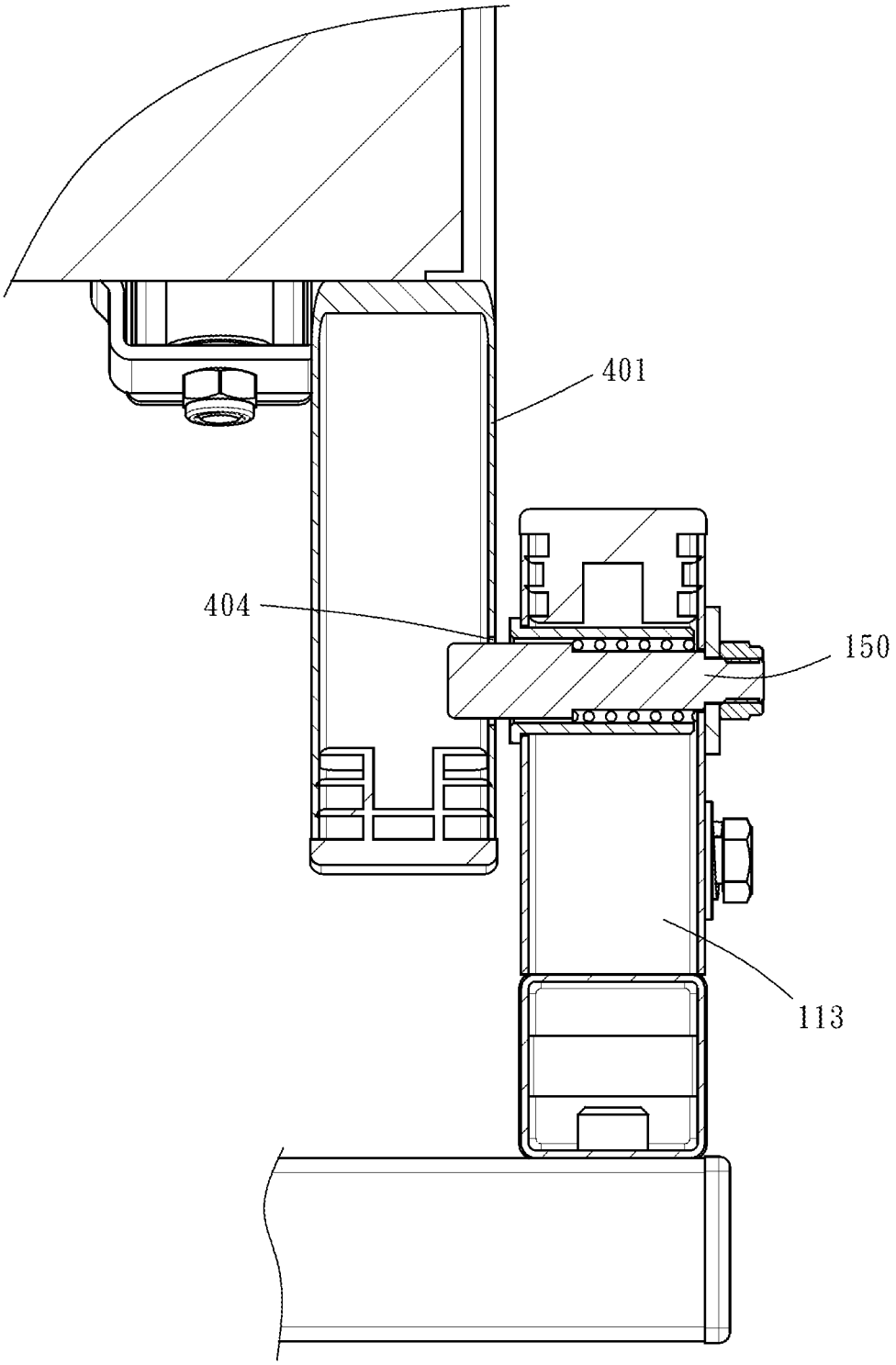
FIG. 9 is a schematic sectional view, illustrating the connection between the third locating member and the third locating portion.

In this embodiment, the second locating member (140) is a locating pin provided at one Y bar (111) of the transverse portion (110) of the base frame (100), and the second locating portion (205) is a pin hole located on one Y bar (201) of the first pivoting frame (200), as shown in FIG. 3 and FIG. 8. By means of plugging the second locating member (140) into the second locating portion (205), the first pivoting frame (200) is prohibited from biasion relative to the base frame (100). In this embodiment, the third locating member (150) is a locating pin provided at one upright (113) of the transverse portion (110) of the base frame (100), and the third locating portion (404) is a pin hole located on one Y bar (401) of the second pivoting frame (400), as shown in FIG. 3 and FIG. 9. By means of plugging the third locating member (150) into the third locating portion (404), the second pivoting frame (400) is prohibited from biasing relative to the base frame (100).

What is claimed is:

1. A dual-purpose work chair, comprising:

a base frame (100) comprising: a transverse portion (110), a longitudinal portion (120) and a plurality of rollers (130) provided at a bottom side thereof for supporting said base frame (100) on the floor or a supporting surface for allowing movement of said base frame (100) on said floor or said supporting surface by rolling said rollers (130), said longitudinal portion (120) being vertically located on said transverse portion (110);

a first pivoting frame (200) pivotally connected to said transverse portion (110) of said base frame (100) and protruding beyond said base frame (100) and biasable relative to said transverse portion (110) of said base frame (100) between a horizontal position and a vertical position;

a lower seat cushion (300) located on said first pivoting frame (200);

a second pivoting frame (400) pivotally connected to said longitudinal portion (120) of said base frame (100) and biasable relative to said longitudinal portion (120) of said base frame (100) between a vertical position and a horizontal position;

and an upper seat cushion (500) located on said second pivoting frame (400).

2. The dual-purpose work chair as claimed in claim 1, wherein said transverse portion (110) of said base frame (100) comprises two Y bars (111) and two X bars (112), said X bars (112) of said transverse portion (110) being connected with respective opposite ends thereof to said Y bars (111) of said transverse portion (110); said longitudinal portion (120) of said base frame (100) comprises two Y bars (121) and two X bars (122), said two X bars (122) of said longitudinal portion (120) being pivotally connected with respective opposite ends thereof to said Y bars (121) of said longitudinal portion (120), said Y bars (121) of said longitudinal portion (120) having respective one ends thereof affixed to one said Y bar (111) of said transverse portion (110).

3. The dual-purpose work chair as claimed in claim 2, wherein said first pivoting frame (200) comprises two Y bars (201) and two X bars (202), said X bars (202) of said first pivoting frame (200) having respective two opposite ends thereof respectively connected to said Y bars (201) of said first pivoting frame (200), said Y bars (201) of said first pivoting frame (200) having respective one ends thereof respectively pivotally connected to respective one ends of said Y bars (111) of said transverse portion (110) of said base frame (100) remove from said longitudinal portion (120) of said base frame (100) so that said first pivoting frame (200) is biasable relative to relative to said transverse portion (110) of said base frame (100) between said horizontal position and said vertical position.

4. The dual-purpose work chair as claimed in claim 2, wherein said second pivoting frame (400) comprises two Y bars (401) and two X bars (402), said two X bars (402) of said second pivoting frame (400) having respective two opposite ends thereof respectively connected to said two Y bars (401) of said second pivoting frame (400), said two Y bars (401) of said second pivoting frame (400) having respective one ends thereof respectively pivotally connected to respective one ends of said two Y bars (121) of said longitudinal portion (120) of said base frame (100) remote from said transverse portion (110) of said base frame (100) so that said second pivoting frame (400) is biasable relative to said longitudinal portion (120) of said base frame (100) between said vertical position and said horizontal position.

5. The dual-purpose work chair as claimed in claim 1, wherein said second pivoting frame (400) is provided with a first locating member (403), and said first pivoting frame (200) is provided with a first locating portion (204), said first locating member (403) being fastenable to said first locating portion (204) to lock said second pivoting frame (400) to said first pivoting frame (200).

6. The dual-purpose work chair as claimed in claim 3, wherein said Y bars (201) of said first pivoting frame (200) are pressed against one said X bar (112) of said transverse portion (110) of said base frame (100) to prevent said first pivoting frame (200) from rotating at an excessive angle when said first pivoting frame (200) is rotated from said horizontal position to said vertical position.

7. The dual-purpose work chair as claimed in claim 3, wherein said base frame (100) further comprises a second locating member (140) and said first pivoting frame (200) further comprises a second locating portion (205) for the fastening of said second locating member (140).

8. The dual-purpose work chair as claimed in claim 7, wherein said second locating member (140) is located on one said Y bar (111) of said transverse portion (110) of said base frame (100); said second locating portion (205) is located on one said Y bar (201) of said first pivoting frame (200).

9. The dual-purpose work chair as claimed in claim 4, wherein said base frame (100) further comprises a third locating member (150) and said second pivoting frame (400) further comprises a third locating portion (404) for the fastening of said third locating member (150).

10. The dual-purpose work chair as claimed in claim 9, wherein said third locating member (150) is located on an upright (113) of said transverse portion (110) of said base frame (100); said third locating portion (404) is located on one said Y bar (401) of said second pivoting frame (400).

* * * * *